US006120625A

United States Patent [19]

Zhou et al.

[11] Patent Number: 6,120,625

[45] Date of Patent: Sep. 19, 2000

[54] PROCESSES FOR PRODUCING FINE GRAINED METAL COMPOSITIONS USING CONTINUOUS EXTRUSION FOR SEMI-SOLID FORMING OF SHAPED ARTICLES

[76] Inventors: Youdong Zhou, 1302 Hillside Ave., Niskayuna, N.Y. 12309; Jian Lu, 252 Tinkerhill CV, apt. D, Jackson, Tenn. 38305; Navtej Singh Saluja, 39 Chilton St., Floor 2, Cambridge, Mass. 02138; Alfredo Riviere V., Celle el Lindero, Quinta Aurat Cerro Verde, 20 Caracas, Venezuela

[21] Appl. No.: 09/095,217

[22] Filed: Jun. 10, 1998

[51] Int. Cl.[7] ..... C22F 1/04; C22F 3/00

[52] U.S. Cl. ..... 148/690; 266/103; 266/249

[58] Field of Search ..... 148/559, 561, 148/689, 690; 266/102, 103, 249

[56] References Cited

U.S. PATENT DOCUMENTS

| | | | |
|---|---|---|---|
| 3,902,544 | 9/1975 | Flemings et al. . | |
| 3,948,650 | 4/1976 | Flemings et al. . | |
| 3,954,455 | 5/1976 | Flemings et al. . | |
| 4,106,956 | 8/1978 | Bercovici . | |
| 4,229,210 | 10/1980 | Winter et al. . | |
| 4,310,352 | 1/1982 | Manfre et al. . | |
| 4,415,374 | 11/1983 | Young et al. . | |
| 5,009,844 | 4/1991 | Laxmanan . | |
| 5,015,438 | 5/1991 | Ashok et al. . | |
| 5,262,123 | 11/1993 | Thomas et al. | 419/67 |
| 5,383,347 | 1/1995 | Riviere et al. | 72/260 |
| 5,533,562 | 7/1996 | Moschini et al. . | |
| 5,571,346 | 11/1996 | Bergsma . | |
| 5,598,731 | 2/1997 | Riviere et al. | 72/260 |
| 5,630,466 | 5/1997 | Garat et al. . | |
| 5,680,894 | 10/1997 | Kilbert | 164/312 |
| 5,685,357 | 11/1997 | Kato et al. | 164/113 |
| 5,740,688 | 4/1998 | Saluja et al. | 72/262 |
| 5,787,959 | 8/1998 | Zaxmanan et al. | 164/66.1 |
| 5,846,350 | 12/1998 | Bergsma | 184/549 |
| 5,878,804 | 3/1999 | Williams et al. | 164/61 |

OTHER PUBLICATIONS

"Semi–Solid Thermal Transformations of Al–Si Alloys and the Resulting Mechanical Properties", *Matl. Sci. Engin.* A237:24 (Sep. 1997).

"Microstructural Evolution During Partial Remelting of Al–Si7Mg Alloys", *Matl. Sci. Engin.* A203:1 (1995).

"Semisolid Melting Casting and Forging", ASM 15:327.

*Primary Examiner*—Daniel J. Jenkins

*Attorney, Agent, or Firm*—Choate, Hall & Stewart

[57] ABSTRACT

There are provided a continuous frictional extrusion process for continuously producing a deformed fine grain solid metal composition suitable for semi-solid forming. The process is featured by a large range of produce dimension and by precise control of the process parameter, such as total deformation, extrusion temperature and speed. The total deformation is controlled to be larger than a Mises effective strain of 2.3 to obtain a deformed fine grain structure with enough distortion energy stored, having a grain size less than 30 μm and a subgrain size less than 2 μm. A method combining the continuous extrusion process of preparing semi-solid raw material with semi-solid forming of shaped articles is also disclosed.

38 Claims, 6 Drawing Sheets

PROCESSES FOR PRODUCING FINE GRAINED METAL COMPOSITIONS USING CONTINUOUS EXTRUSION FOR SEMI-SOLID FORMING OF SHAPED ARTICLES

FIELD OF THE INVENTION

The invention herein relates to methods for producing fine grained metal compositions for use in semi-solid metal forming and for semi-solid forming of shaped articles.

BACKGROUND OF THE INVENTION

Semi-solid metal forming, i.e., forming a metallic alloy at a temperature between its equilibrium liquidus and equilibrium solidus temperatures, is a hybrid metalworking process combining the elements of both casting and forging/extrusion. One of the key elements for the successful operation of a semi-solid forming process is the microstructure of metallic alloy being thus formed.

Conventionally solidified metals cannot be utilized in a semi-solid condition, since a structure of dendritic network forms upon solidification in such metals. Cracks and segregates will occur when a conventionally solidified metal is formed in partially liquid/solid state. Previous studies have shown that raw material of a semi-solid forming process must have a structure comprised of globular or spheroidal grains contained in a lower melting alloy matrix. When heated to a semi-solid temperature, the globular solid phase is retained, suspended in a lower melting alloy liquid matrix. The term "metal" is used to designate a metallic alloy with a major metallic constituent (base metal) along with various amounts of intentional additions (metallic and non-metallic) that modify the property of the base metal, as well as trace impurities that are deemed to not greatly deteriorate the performance of the alloy when used to fabricate articles thereof.

Producing semi-solid raw material requires specialized techniques. Thermal transformation processes are disclosed in U.S. Pat. Nos. 4,106,956, 5,009,844 and 5,571,346 where solidified metal having a fine dendritic microstructure is heated to and maintained at a superheated temperature above the solidus temperature of the metal, while keeping its body in a solid shape. After the dendritic networks are thermally transformed into globular solid particles, the metal is then formed in semi-solid conditions into an article.

Vigorous agitation processes are disclosed in U.S. Pat. Nos. 3,902,544, 3,948,650, 3,954,455, 4,310,352 (mechanical stirring) and U.S. Pat. No. 4,229,210 (inductive electromagnetic stirring) where during billet casting, a metal is agitated while it is in the semi-solid state and then cooled to solidify, forming the primary solid phase comprising discrete degenerate dendrites or nodules while preventing the formation of interconnected dendritic networks. Among the various agitation processes, the magnetohydro-dynamic (MHD) casting process has been commercially applied for producing a variety of fine-grain (mean grain effective diameter about 30 $\mu$m) aluminum alloy bars (diameters varying from 38 to 152 mm) which satisfy the requirements of semi-solid forming.

However the agitation processes have practical limitations for casting bars with diameters less than about one inch due to very low productivity. U.S. Pat. No. 4,415,374 discloses a "SIMA" (strain induced, melt activated) process to make raw material for semi-solid forging. In the process, a solid metal composition is prepared by heating a conventionally solidified and homogenized ingot to a temperature in the hot deformation range of the metal, followed by hot extrusion or hot rolling plus additional cold working, resulting in an essentially directional grain structure. By heating the composition to a temperature above the solidus and below the liquidus, its directional grain structure transforms to a partially solid, partially liquid mixture comprising of uniform discrete spheroidal particles contained in a lower melting liquid matrix. The heated alloy is then formed and solidified while in a partially solid, partially liquid condition, the solidified article having a uniform, fine grained microstructure.

In comparison with MHD casting, the SIMA process provides an effective method for producing small-diameter alloy bars (diameter less than 38 mm or 1.5 in.) employed in semi-solid forging. For large sizes, however, the economics of the process are not competitive with those of MHD casting for most metal alloys. On the other hand, the procedure of the SIMA process is very cumbersome, comprising the five discrete operations: conventional casting, ingot homogenization, heating, hot working and cold working. The nature of the process limits its application on a practical and economical scale, for not only large size but also small size semi-solid raw materials. In addition, the requirement of cooling to room temperature and reheating for further processing is very costly.

Therefore, it is an object of the present invention to provide a more superior process for producing a fine-grained solid metal composition suitable for semi-solid metal forming.

It is another object of the present invention to provide a more economical process for producing a fine-grained solid metal composition suitable for semi-solid metal forming.

It is another object of the present invention to provide a process and apparatus for preparing semi-solid precursor material covering a large range of sizes.

It is a further object of the present invention to provide a process and apparatus for preparing, delivering and semi-solid forming the above precursor material.

SUMMARY OF THE INVENTION

The present invention provides a simpler and more flexible process for producing deformed fine grain solid metal compositions suitable for semi-solid forming than any other known process. In one aspect of the present invention, a continuous extrusion process is used for providing a solid metal composition and structure suitable for semi-solid forming, wherein a continuous frictional extrusion apparatus is employed. This includes a frictional extrusion source, a transfer chamber for collecting frictionally extruded material received from the extrusion source, and an extrusion die with a die holding set. "Frictional extrusion source" is used in the conventional sense to mean any apparatus or portion thereof which utilizes the friction engagement of a feed material between moving and non-moving surfaces to generate extrusion pressure.

The feedstock of the continuous extrusion process can be a solid, powder or granules, or molten metal. In the continuous extrusion process with solid metal feedstock, the continuously fed solid metal first undergoes a small amount of cold work when it enters the friction engagement, and then undergoes a large amount of warm and/or hot extrusion deformation (preferably larger than a Mises effective strain of 2.3) where the temperature in the deformed metal increases due to the friction and internal strain energy. The above mentioned friction-generated extrusion pressure then pushes the metal through the transfer chamber and extrudes the metal through the extrusion die at the end of the transfer chamber. The extrudate that thus emerges from the extrusion die is microstructurally characterized by deformed fine grains, with mean grain effective diameter less than 30 um (micron), and mean subgrain effective diameter less than 2 um. Changing the sizes of the transfer chamber and extrusion die can provide a large range of dimensions for the extruded solid metal. Following extrusion, the extrudate composition can be optionally quenched, and optionally sawed or sheared to short lengths. On-line quenching and on-line sawing or shearing are preferred.

In an alternative embodiment, a powder/granule feed may be used in the continuous extrusion process. The powder or granules are first compacted and sintered to eliminate porosity, instead of cold working as in the case of solid metal feedstock.

In yet another alternative embodiment, molten metal feedstock may be used. For molten metal feedstock, solidification occurs before hot extrusion. The solidification rate for the molten metal is preferred to be in a range of 10 to 150° C./s to obtain a fine dendritic microstructure in the solidified metal, with the dendritic grain size in the range of 20 to 150 $\mu$m, and the dendritic arm spacing in the range of 2 to 30 $\mu$m.

The deformed fine grain metal composition is then heated to a temperature between the solidus and liquidus temperatures of the metal to provide a microstructure which consists of discrete spheroidal particles of 30 to 150 $\mu$m suspended in a lower melting liquid matrix. Spheroidal particles suspended in a lower melting liquid matrix are converted into a semi-solid structure which contains 10 to 90% solid phase.

In another aspect of the present invention a method is provided which combines the extrusion process for preparing semi-solid precursor material with a process of semi-solid forming of this precursor material into shaped articles. The apparatus employed in this method includes the continuous frictional extrusion machine, means for on-line sawing or shearing the extruded metal into slugs of required length, means for heating the slugs to a temperature between the solidus and liquidus temperatures of the metal, means for delivering the extruded and heated slugs to the forming machine, and means for semi-solid die casting or semi-solid forging the slugs into shaped articles.

The preferred feedstock for the extrusion process to produce precursor material is a solid rod with a diameter of 5 to 40 mm, preferably 10 to 30 mm and of the same composition as the desired precursor material. The rod is fed into the continuous frictional extrusion machine, cold worked first and them warm and/or hot extruded to produce an extrudate with a deformed fine grain structure having a grain size less than 30 $\mu$m and a subgrain size less than 2 $\mu$m. The extrudate is then on-line sawed or sheared into slugs of required length. The slugs are then delivered to the heating means to be heated at a rate of 0.5 to 20° C./s from the hot extrusion temperature to a temperature between the solidus and liquidus temperatures of the metal, and holding the heated at the temperature for 1 to 30 minutes. The heated slugs are then delivered to the forming machine. Semi-solid die casting or semi-solid forging can be used to shape the heated "semi-solid" slugs at injection speeds of 0.5 to 15 m/s. The slugs are typically shaped by utilizing a hydraulically powered ram to force into a die or mold (as in die-casting) or by closed die drop-forging (as in forging). Optionally, the semi-solid forging can be multi-stage process where the slug is preformed. The preformed slug can then be either solid forged or semi-solid forged into the article.

BRIEF DESCRIPTION OF THE DRAWING

The invention is described with reference to the following drawings, in which.

DETAILED DESCRIPTION OF THE INVENTION

Figure 1:
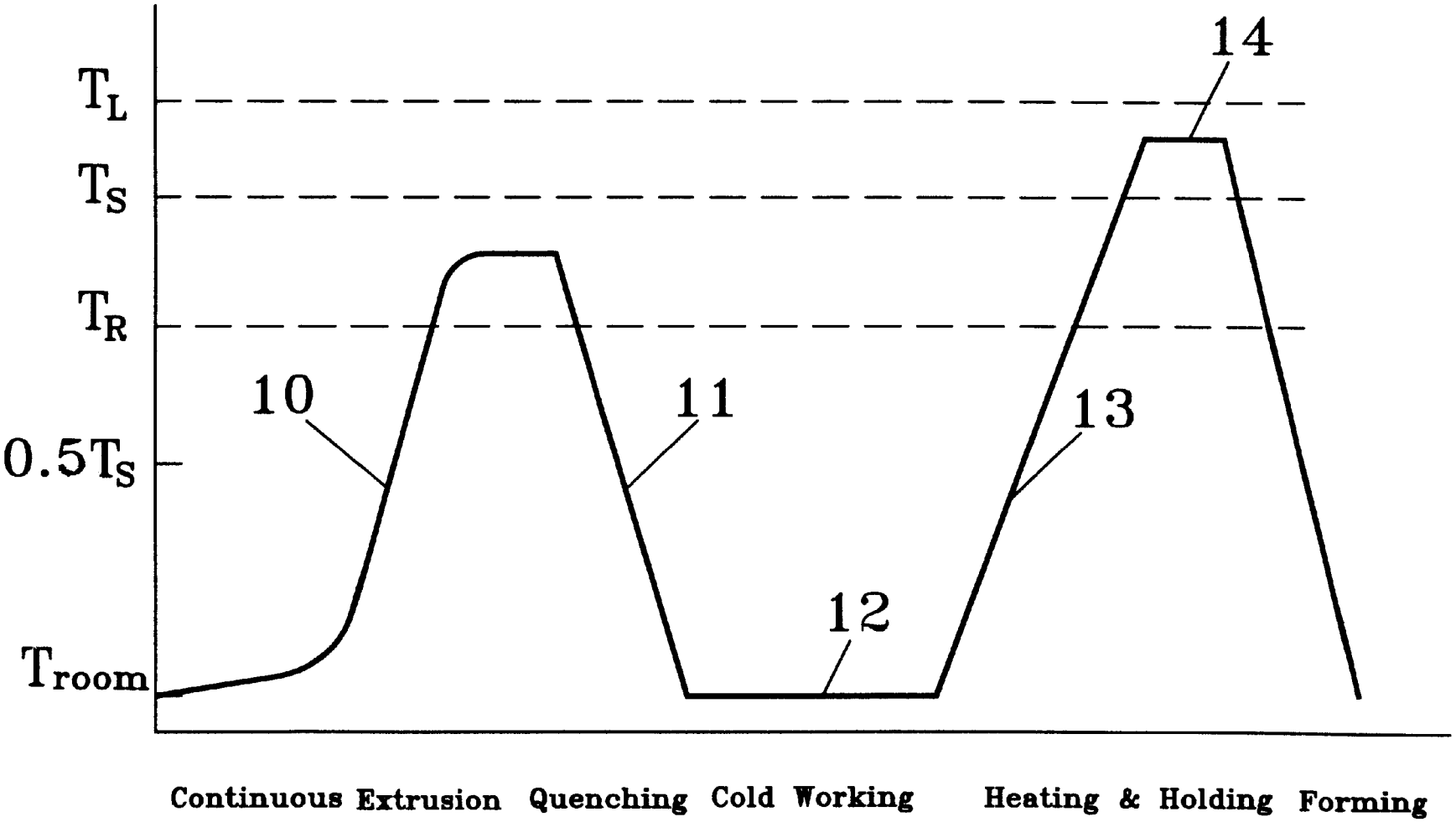
FIG. 1 is a schematic time-temperature profile in accordance with the process of continuous extrusion with a solid feedstock of the present invention.

I. Continuous Extrusion Process for Producing a Solid Metal Composition Suitable for Semi-solid Forming The method of the invention provides a simpler and more flexible process for preparing a deformed fine grain solid metal composition suitable for semi-solid forming. Continuous frictional extrusion followed by quenching is used to provide the requisite fine grained metal feed material. FIG. 1 illustrates a typical schematic time-temperature profile corresponding to the aspect of the present invention. The vertical axis is temperature; the horizontal is time. With reference to FIG. 1, the feed material is introduced into a frictional extrusion apparatus where frictional forces raise the temperature above $T_{recrystallization}$, as indicated in step 10. The extrusion forces applied to the feed material provide an extrudate characterized by a deformed fine grain structure. The extrudate is then optionally quenched in a quenching step 11 and optionally cold worked as indicated by step 12. The deformed fine grain microstructure extrudate is heated in a heating step 13, which provides a microstructure which consists of discrete spheroidal particles suspended in a lower melting liquid matrix. Thereafter, the metal may be semi-solid formed in conventional forming operations (shown in step 14) to provide shaped articles.

Figure 2:
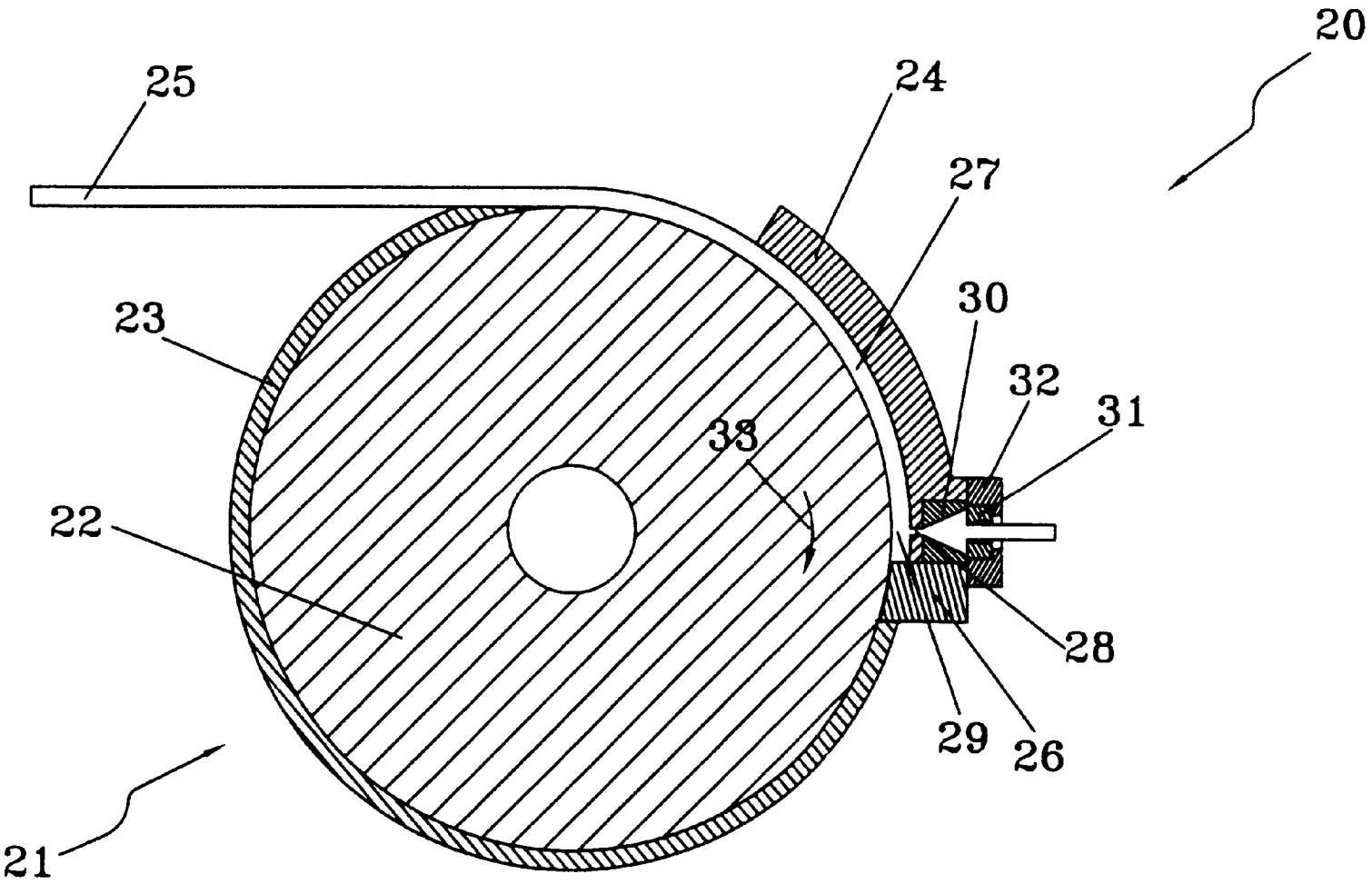
FIG. 2 is a schematic cross-sectional side view of a frictional extrusion apparatus in accordance with the process of continuous extrusion of the present invention.

A schematic cross-sectional side view of a conventional frictional extrusion apparatus which may be used in accordance with the invention is depicted in FIG. 2. A typical frictional extrusion apparatus 20 includes a frictional extrusion source 21, such as the one described hereinbelow. The frictional extrusion source 21 is in communication with a transfer chamber 30 which collects a frictionally extruded material 29 from the frictional extrusion source 21. An extrusion die 31 held by a die holding set 32 is connected with the transfer chamber, such that the material 29 is pushed by an extrusion pressure generated from frictional extrusion source 21 through the transfer chamber 30 and is extruded in the extrusion die 31. The frictional extrusion source 21 suitable for use in the present invention has a rotatable wheel 22 having a circumferential endless groove 23 therein. The groove 23 is engaged with a shoe member 24 having an abutment 26 which intrudes into the groove 23, thereby blocking the whole of passageway 27 which is defined by the groove 23 and shoe member 24. An opening 28 is positioned near the abutment 26 for the release of the frictionally extruded material 29. The opening 28 can be situated in the shoe so that the frictionally extruded metal 29 exits either radially or tangentially from the wheel 22.

In operation according to the present invention, the wheel 22 is rotated in the direction indicated by arrow 33. A feed material 25 moves forward into passageway 27 where it meets abutment 26. The frictional drag on the feed material 25 creates sufficient frictional pressure to extrude the feed material through the opening 28. Usually the deformation resulting from friction extrusion contains a large fraction of shear strain. The extrusion apparatus 20 may have one or more passageways 27. The feedstock of the continuous extrusion process can be a solid, powder or granular, or molten metal. In the case of a solid metal feedstock, the continuously fed solid metal 25 is first subjected to a small amount of cold working when being dragged in the passageway 27 by the friction. The metal then usually is subjected to a large amount of warm and/or hot extrusion deformation when it is extruded by the frictional pressure through the opening 28. By the frictional pressure, the frictionally extruded metal out of the opening 28 is then continuously pushed through the transfer chamber 30 and extruded in the extrusion die 31 to obtain a deformed fine-grain solid metal composition suitable for semi-solid forming.

A deformed fine grain microstructure is desired for the deformed metal to be used in semi-solid forming, since the structure can be transformed into a microstructure which comprises spheroidal particles uniformly distributed in the lower melting liquid when the metal is reheated to a temperature between the solidus and liquidus temperatures of the metal. This is because there is distortion energy stored in the deformed fine grain microstructure. Deformation energy stored in the deformed metal promotes the microstructure transformation by increasing the diffusion rate of the low melting element to grain and subgrain boundaries, resulting in quick melting near grain or subgrain boundaries when the deformed metal is quickly heated to a semi-solid temperature. The stored distortion energy also induces recrystallization when reheating the deformed and quenched metal to above the recrystallization temperature of the metal. The greater the stored distortion energy, the more recrystallized nuclei can be obtained, leading to finer spheroidal particles when the deformed metal is quickly heated to a semi-solid temperature.

Therefore, the total deformation of the continuous extrusion desirably is greater enough to provide a fine-grained deformation microstructure with enough distortion energy stored in the extruded metal to produce a microstructure upon heating comprising spheroidal particles uniformly distributed in a lower melting liquid. With respect to the present invention, the amount of extrusion deformation is desirably larger than a Mises effective strain of 2.3 to obtain enough distortion energy stored in the deformed metal. The amount of deformation can result in a deformed fine grain structure having a grain size less than 30 $\mu$m and a subgrain size less than 2 $\mu$m in the frictionally extruded metal.

During the process of continuous extrusion, the temperature in the deformed metal increases gradually due to the heat generated from friction and deformation. No heating means are needed in the frictional extrusion source 21, although heat may be applied optionally. The present invention encompasses any extrusion temperature between room temperature to the solidus temperature of the metal. In order to avoid cracks and hotshortness in the extrudate, in accordance with the present invention, the extrusion temperature is preferred to be in the range between the warm and hot deformation temperature, i.e. from 0.5 to 0.95 $T_{solidus}$ Kelvin. If the dimensions of the extrudate are larger than that of the opening 28, the extrusion temperature is preferred to be between the recrystallization temperature (0.7 $T_{solidus}$ Kelvin) to 0.95 $T_{solidus}$ Kelvin, but more preferably to be above but close to the recrystallization temperature of the metal to obtain more distortion energy stored in the metal, as long as no cracks occur in the extrudate. Optionally heating the transfer chamber 30 and extrusion die 31 to achieve the desired extrusion temperature therein is also included in the present invention.

Any achievable strain rates of extrusion are found to be suitable for the process of the present invention and are encompassed in the present invention. A high strain rate is preferred by the present invention to obtain high productivity. Following extrusion, the extruded metal composition can be optionally quenched, and is then sawed or sheared to short lengths. On-line quenching and on-line sawing or shearing are preferred.

In the continuous extrusion process with powder or granular metal feedstock, the powder or granules are first compacted and sintered to eliminate porosity and to obtain a rigid body ready for plastic deformation, rather than cold worked like in the case of solid metal feedstock. For a molten metal feedstock, before hot extrusion, solidification occurs when the molten metal is delivered into the passageway 27. In order to obtain a fine dendritic microstructure, the solidifying rate is preferred to be in a range of 10° C. To 150° C./s for aluminum alloys in accordance with the present invention. The dendritic structure is preferred to have fine dendritic grains of 20 to 150 $\mu$m with dendritic arm spacing of 2 to 30 $\mu$m.

The deformed fine grain metal composition to is then heated to a temperature between the solidus and liquidus temperatures of the metal in order to obtain a microstructure which consists of discrete spheroidal particles suspended in a lower melting liquid matrix. Spheroidal particles are preferably in the range of about 30 to 150 $\mu$m. Spheroidal particles suspended in a lower melting liquid may be converted into a semi-solid structure which contains 10 to 90% solid phase.

The semi-solid material can then be formed by one of the many metal forming processes, e.g., high pressure die casting or forging, characterized by high tool life, near-net shape and lower requirement of forming pressure. After semi-solid forming and solidifying the metal composition, therefore, fine grained microstructure with average grain size of 50 to 150 $\mu$m comprising discrete spheroidal grains uniformly distributed in a lower melting matrix is obtained in the metal, resulting in an article with superior mechanical properties.

The heating rate is factor in obtaining a fine spheroidal grain microstructure of desired dimensions. The reheating rate should allow for recrystallized nuclei to be formed but not provide enough time for the nuclei to grow up before temperature of the metal reaches its solidus temperature, in order to assure a desired fine spheroidal grain microstructure in the semi-solid formed metal. For aluminum alloys, a reheating rate in the range of 0.5 to 20° C./s is preferred by the present invention. When the metal is reheated to a semi-solid temperature, maintaining at the temperature is necessary to allow enough time for the microstructure to be transformed into discrete spheroidal particles suspended in a lower melting liquid. The maintaining time can be between a few seconds and some hours, depending on the nature of the metal and the required solid-liquid fraction. For a semi-solid aluminum having a solid fraction of 10 to 45%, the maintaining time of 10 to 30 minutes is preferred by the present invention, while for 45 to 90% solid fraction the maintaining time of 1 to 10 minutes is preferred.

Changing the sizes of the transfer chamber and extrusion die can provide a large range of dimension for the extrudate. Therefore, the present invention provides a simpler and more flexible process of producing deformed fine grain solid metal compositions suitable for semi-solid forming than any other known process. Also, the continuous extrusion process for preparing semi-solid raw materials can be completed in one operation, instead of 5 operations in the SIMA process. Since it is a continuous process, the productivity is also high and the process is more precisely controlled, thus giving reproducible results for each "run".

II. Process for Semi-solid Forming of Shaped Articles

The aspect of the present invention provides a method which combines the precursor extrusion process of preparing semi-solid raw material with a process of semi-solid forming of shaped articles. The apparatus employed in this method includes the continuous frictional extrusion machine (FIG. 2), means for on-line sawing or shearing the extruded metal to slugs with a required length, means for heating the slugs to a temperature between the solidus and liquidus temperatures of the metal, means for delivering the extruded and heated slugs, and means for semi-solid forming the slugs to shaped articles. The feedstock for preparing a semi-solid raw material from continuous extrusion can be a solid, powder or granular, or molten metal. From the present invention, a solid rod feedstock is preferred, which has a diameter of 5 to 40 mm, preferably 10 to 30 mm.

Figure 4:
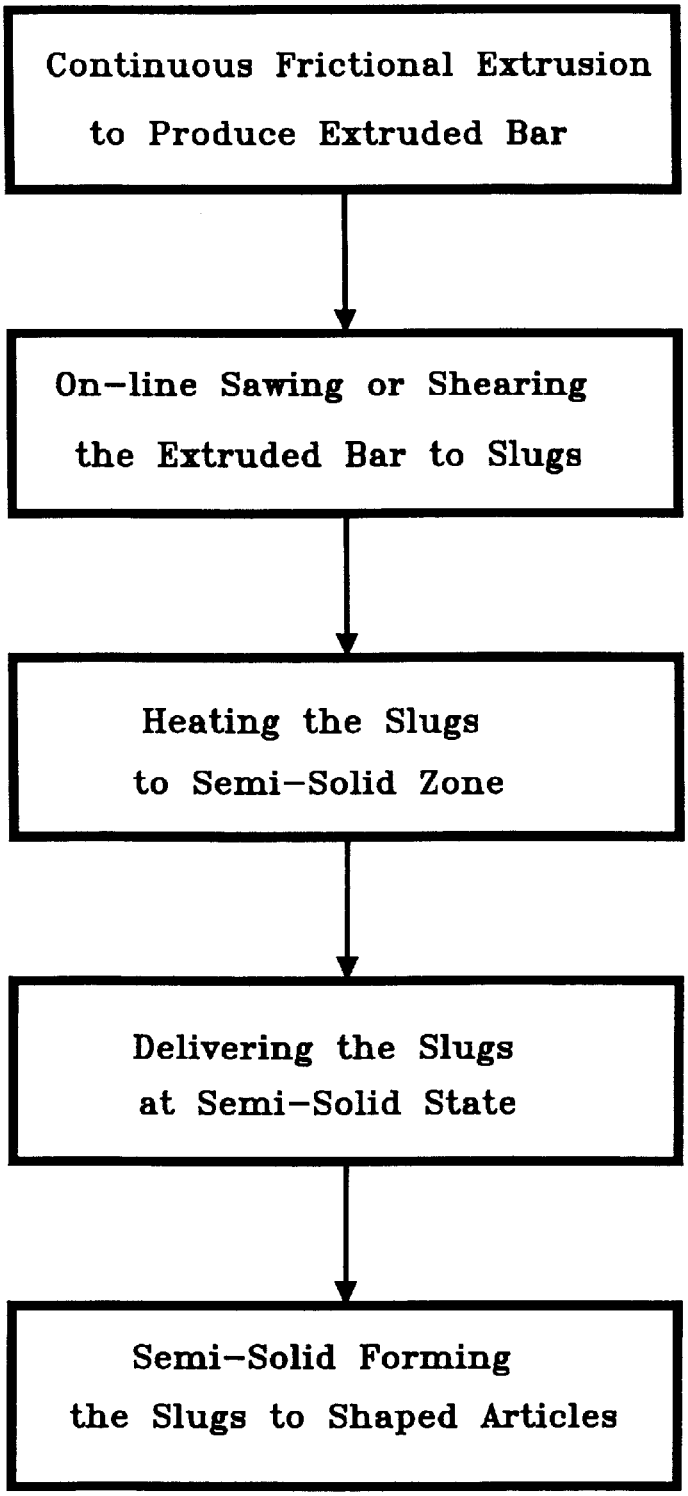
FIG. 4 is a flow chart showing the various steps in the process for semi-solid forming of shaped articles in the present invention.
Figure 5:
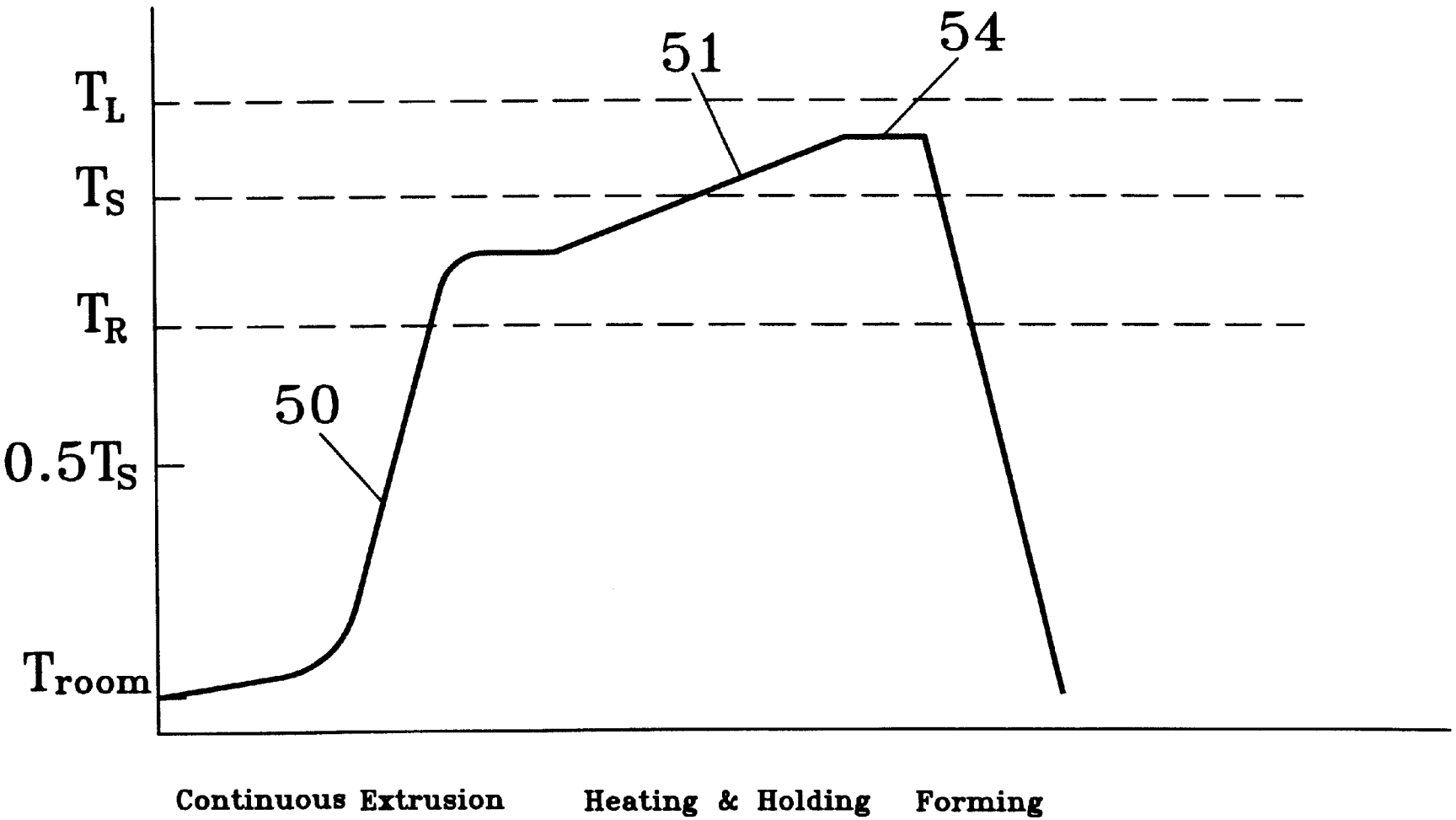
FIG. 5 is a schematic time-temperature profile in accordance with the process for semi-solid forming of shaped articles in the present invention.

FIG. 4 shows a flow chart of the steps in the process corresponding to the present invention, and FIG. 5 is a schematic time-temperature profile in accordance with in the present invention. With reference to FIG. 5, the feed material is introduced into a frictional extrusion apparatus where frictional forces raise the temperature above $T_{recrystallization}$, as indicated in step 50. The extrusion forces applied to the feed material provide an extrudate characterized by a deformed fine grain structure. The extrudate is then optionally further heated in a heating step 51 to a temperature between $T_{solidus}$ and $T_{liquidus}$ of the metal extrudate which provides a microstructure which consists of discrete spheroidal particles suspended in a lower melting liquid matrix. Thereafter, the metal may be semi-solid formed in conventional forming operations (shown in step 54) to provide shaped articles. As can be seen, the method is quite streamlined and provides a efficient and cost-effective method of obtaining near-net shaped articles in a semi-solid forming operation. The process takes advantage of the heat acquired by the extrudate during the extrusion process and eliminates quenching and a costly reheating steps.

With reference to FIG. 4, a rod is fed continuously into the continuous frictional extrusion machine, wherein it is cold worked first and then warm and/or hot extruded by the extrusion pressure generated by the friction formed between the rod 35 and the grooves 23 and between the rod and the shoe 24 (FIG 2). With respect to the present invention, the amount of the effective extrusion deformation is preferred to be larger than a Mises strain of 2.3 to obtain a deformed fine grain structure having a grain size less than 30 $\mu$m and a subgrain size less than 2 $\mu$m in the extrudate.

Such a microstructure can be transformed into a fine spheroidal particle structure when the deformed metal is heated to a semi-solid state. Due to the heat generated from friction and deformation, the temperature in the deformed rod increases gradually during extrusion. The present invention encompasses any extrusion temperature between room temperature to the solidus temperature of the metal. In order to avoid cracks and hotshortness in the extrudate, in accordance with the present invention, the extrusion temperature is preferred to be in the range from the warm to hot deformation temperature (0.5 to 0.95 $T_{solidus}$ Kelvin). If the dimension of the extrudate is larger than that of the opening 28, moreover, the extrusion temperature is preferred to be between the recrystallization temperature (0.7 $T_{solidus}$ Kelvin) to 0.95 $T_{solidus}$ Kelvin, but more preferably to be above but close to the recrystallization temperature of the metal to obtain more distortion energy stored in the metal as long as no cracks occur in the extrudate. Optionally heating the transfer chamber 30 and extrusion die 31 to achieve a desired temperature is also included in the present invention.

Continuously, the extruded rod with the extrusion temperature is then on-line sawed or sheared to slugs with a required length. Optionally quenching can be proceeded before or after sawing/shearing. The precursor slugs are delivered to the heating means and heated at a specific heating rate to a temperature between the solidus and liquidus temperatures of the metal and retaining at the temperature for a specific time. It can be obtained a microstructure which consists of discrete spheroidal particles suspended in a lower melting liquid matrix. Spheroidal particles suspended in a lower melting liquid matrix are turned to be a semi-solid structure which contains 10 to 90% solid phase. The rate of heating is important for obtaining such a fine spheroidal particle microstructure. The heating rate should allow for recrystallized nuclei to be formed but not provide enough time for the nuclei to grow up before temperature of the metal reaches its solidus temperature, in order to assure a desired fine spheroidal grain microstructure in the semi-solid formed metal. For aluminum alloys, a reheating rate in the range of 0.5 to 20° C./s is preferred by the present invention.

When the metal is heated to a semi-solid temperature by the heating means, maintaining at the temperature is necessary to allow enough time for the microstructure to be transformed into discrete spheroidal particles suspended in a lower melting liquid. The maintaining time depends on the nature of the metal and the required solid-liquid fraction. For a semi-solid aluminum having a solid fraction of 10 to 45%, the maintaining time of 10 to 30 minutes is preferred by the present invention, while for 45 to 90% solid fraction, the maintaining time of 1 to 10 minutes is preferred. The heating means can be any type of furnace, as long as it can heat the precursor slugs uniformly at the required heating rate. For this reason, inductive heating is preferred by the present invention due to its nature of uniform heating and precisely controllable high heat-up rate. If the time for maintaining at a semi-solid temperature is long, e.g. more than 10 minutes for aluminum alloys, a forced-convection-heated furnace claimed from U.S. Pat. No. 5,533,562 is also preferred by the present invention.

After the heating, the deformed fine grain microstructure is transformed to that comprises discrete spheroidal particles of 50 to 150 $\mu$m uniformly distributed in a lower melting liquid matrix. The heated slugs are then delivered to the means of semi-solid forming, e.g., a high pressure die casting or forging apparatus. Preferably, the high pressure die casting machine can provide injection speed of 0.5 to 15 m/sec. and injection pressure of 5 to 50 MPa with injection force of 10 to 50 tons, and mold locking force of 300 to 1200 tons.

Because of the spheroidal particle microstructure in the semi-solid slugs, the process of semi-solid forming is characterized by high tool life, near-net shape and lower requirement for forming pressure. After semi-solid forming and solidifying the metal composition, therefore, fine grained microstructure with average grain size of 50 to 150 μm comprising discrete spheroidal grains uniformly distributed in a lower melting matrix is obtained in the metal composition, resulting in a product with superior mechanical properties.

Example 1

A continuously cast and rolled rod with F-temper and 15 mm diameter of aluminum alloy (Aluminum Association Alloy 6061) containing 0.65 wt. % silicon, 1.03wt. % magnesium, 0.27 wt. % copper and the balance aluminum and incidental impurities, was frictionally extruded to a rod with the diameter of 10 mm, in accordance with the present invention. The maximum extrusion temperature was 540° C. which is approximately 42° C. below the solidus temperature of the alloy. The effective deformation resulting from the extrusion was equivalent to a Mises strain of 2.5. The extruded rod has a deformed fine grain microstructure having grain size less than 20 μm and subgrain size less than 2 μm. Samples of 15 mm length were cut from the extruded rod and heated inside an infra reflection furnace from room temperature (20° C.) to 590, 610, 620 and 630° C., respectively. The heating rate was 9° C./s. The samples remained at the temperatures for 5, 10, 15 30 and 180 minutes, followed by water quenching to room temperature. Micrographs of the heated and quenched samples show that the microstructures of all the samples, except for the one held for 5 minute, were transformed into a microstructure having spheroidal grains contained in a lower melting matrix.

Figure 3A:
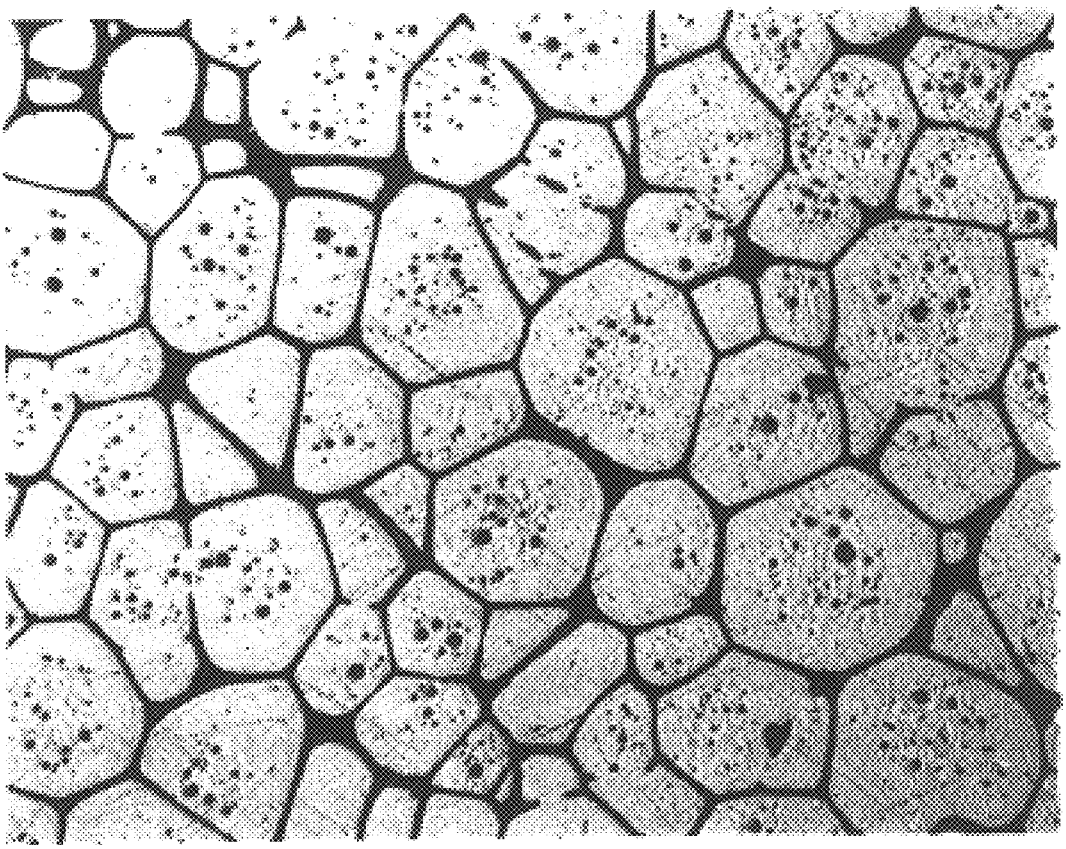
FIG. 3*a* is a micrograph showing the microstructure of the continuously extruded AA6061 after heating to a semi-solid temperature (magnification 100X)
Figure 3B:
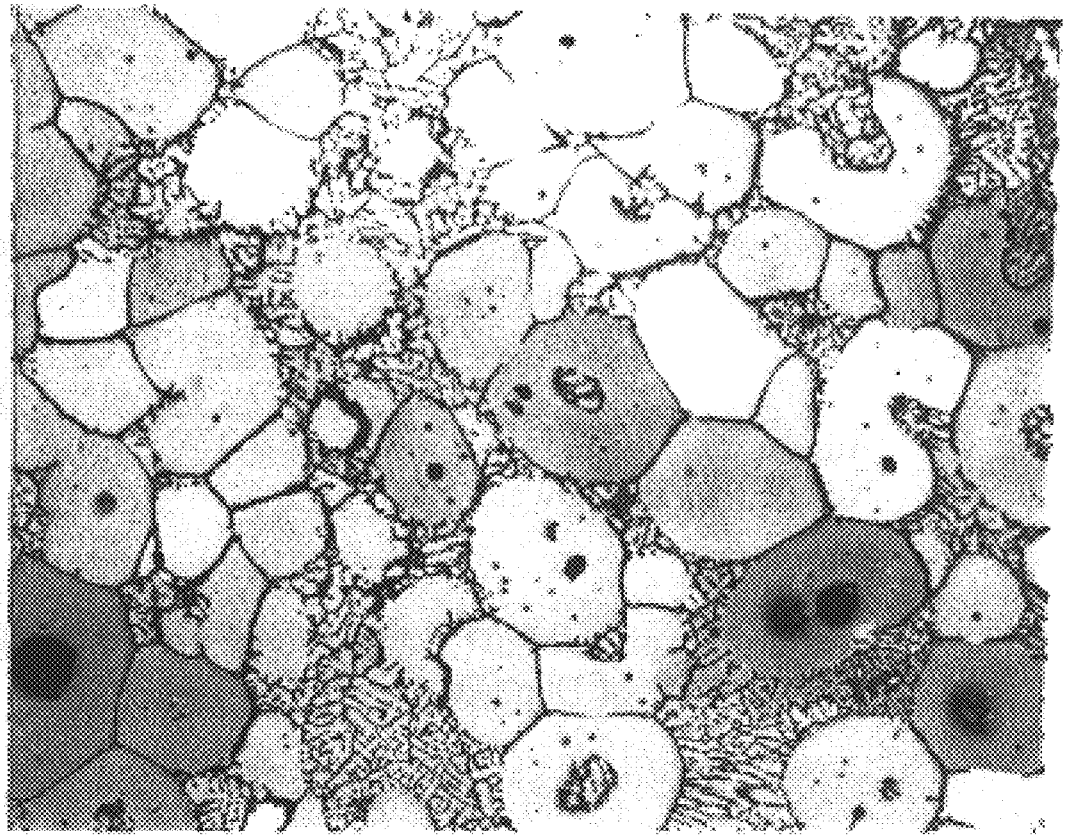
FIG. 3*b* is a micrograph showing the microstructure of the continuously extruded AA6061 after heated to a semi-solid temperature (magnification 100X)

FIG. 3*a* shows the microstructure of the sample after remaining at 620° C. For 15 mins. The globules have an average diameter of 100 μm. FIG. 3*b* depicts the microstructure of the sample after remaining at 630° C., for 10 mins. The globules have an average diameter of 80 μm.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A process for semi-solid forming of shaped articles, comprising:

heating a frictionally extruded metal feed material at a selected heating rate to a temperature between the solidus and liquidus temperatures of the material and maintaining the temperature for a specific time wherein the material acquires a microstructure which consists of discrete spheroidal particles suspended in a lower melting liquid matrix; and semi-solid forming the extruded and heated material to a shaped article.

2. An integral process for semi-solid forming of shaped articles, comprising:

frictionally extruding a metal feed material;

in-line heating the frictionally extruded metal feed material at a selected heating rate to a temperature between the solidus and liquidus temperatures of the metal and maintaining the temperature for a specific time wherein the material acquires a microstructure which consists of discrete spheroidal particles suspended in a lower melting liquid matrix; and semi-solid forming the extruded and heated material to a shaped article.

3. The process of claim 1 or 2, wherein the microstructure comprises spheroidal particles in the range of about 30 to 150 μm suspended in the lower melting liquid matrix.

4. The process of claim 1 or 2, wherein the frictionally extruded material is quenched.

5. The process of claim 1 or 2, wherein the frictionally extruded feed material is sawed or sheared to short lengths prior to heating.

6. The process of claim 2, wherein the frictional extrusion is conducted at an extrusion temperature in the range of the warm to hot deformation temperature of from 0.5 to 0.95 $T_{solidus}$ Kelvin.

7. The process of claim 1 or 2, wherein the frictionally extruded material has a large dimension in the range of 30 to 200 mm.

8. The process of claim 1 or 2, wherein the frictional extrusion is conducted at an extrusion temperature between recrystallization temperature of 0.7 $T_{solidus}$ Kelvin and 0.95 $T_{solidus}$ Kelvin.

9. The process of claim 8, wherein the extrusion temperature is above but close to the recrystallization temperature of the metal.

10. The process of claim 1 or 2, wherein the feed material is in the form selected from the group consisting of a solid, powder, granular, and molten metal.

11. The process of claim 10, wherein the feed material is a solid and the solid feed material is cold worked when dragged into this frictional extrusion apparatus.

12. The process of claim 10, wherein the feed material is a powder or granules and the powdered or granulated feed material is compacted and sintered in the frictional extrusion apparatus prior to extrusion.

13. The process of claim 10, wherein the feed material is a molten metal and the molten feed material is solidified in the frictional extrusion apparatus at a rate which provides a fine dendritic microstructure prior to frictional extrusion.

14. The process of claim 13, wherein the solidifying rate is in a range of 10 to 150° C./s for aluminum alloys.

15. The process of claim 13, wherein the fine dendritic structure comprises dendritic grains of 20 to 150 μm with dendritic arm spacing of 2 to 30 μm.

16. The process of claim 1 or 2, wherein the amount of frictional extrusion is larger than a Mises effective strain of 2.3.

17. The process of claim 1 or 2, wherein the amount of frictional extrusion is sufficient to provide stored distortion energy to form a deformed fine grain structure having a grain size less than 30 μm and a subgrain size less than 2 μm.

18. The process of claim 4, wherein quenching is a liquid quenching.

19. The process of claim 4, wherein the quenching comprises a in-line quenching.

20. The process of claim 5, wherein the sawing or shearing comprises in-line sawing or shearing.

21. The process of claim 4, further comprising:

cold working after the quenching to provide additional stored distortion energy in the deformed fine grain structure of the frictionally extruded material.

22. The process of claim 1 or 2, wherein the heating rate is sufficient to permit recrystallized nuclei to be formed but insufficient to provide enough time for the nuclei to grow up before the solidus temperature is reached during reheating.

23. The process of claim 1 or 2, wherein the heating rate is in the range of 0.5 to 20° C./s for aluminum alloys.

24. The process of claim 1 or 2, wherein the feed material is an aluminum alloy.

25. The process of claim 24, wherein the aluminum alloy has a volume fraction solid of 10 to 45% and the maintaining time is in the range of about 10 to 30 minutes.

26. The process of claim 24, wherein the aluminum alloy while for aluminum alloys having a volume fraction solid of 45 to 90% and the maintaining time is 1 to 10 minutes.

27. The process of claim 2, wherein the extrusion and heating is conducted in a single operation.

28. The process of claim 10, wherein the solid metal is a solid rod having a diameter of 5 to 40 mm.

29. The process of claim 28, wherein the solid rod has a diameter of about 10 to 30 mm.

30. An apparatus employed in the integral process for semi-solid forming of shaped articles, comprising:

a frictional extrusion source for frictionally extruding a metal feedstock;

a transfer chamber in communication with the frictional extrusion source for collecting the frictionally extruded metal from the frictional extrusion source;

an extrusion die held by a die holding set and connected with the transfer chamber, for extruding the frictionally extruded metal from transfer chamber to a required dimension;

means for on-line sawing or shearing the extruded metal to slugs of required length;

means for heating the extruded slugs to a temperature between the solidus and liquidus temperatures of the metal;

means for delivering the extruded and heated slugs; and means for semi-solid forming the extruded and heated slugs to shaped articles.

31. The apparatus of claim 30, wherein the heating means comprises inductive heating.

32. The apparatus of claim 30, wherein the heating means comprises electric forced-convection-heated resistant furnace.

33. The apparatus of claim 30, wherein the means of semi-solid forming comprises forging.

34. The apparatus of claim 30, wherein the means of semi-solid forming comprises high pressure die casting.

35. The apparatus of claim 34, wherein injection pressure is in the range of 5 to 50 MPa with injection force of 10 to 50 tons.

36. The apparatus of claim 35 having an injection speed of about 0.5 to 15 m/sec.

37. The apparatus of claim 34 having a mold locking force of about 300 to 1200 tons.

38. The apparatus of claim 30, further comprising:

heating the transfer chamber and extrusion die to achieve a desired extrusion temperature therein.

* * * * *